US005634826A

United States Patent [19]

Jean et al.

[11] Patent Number: 5,634,826

[45] Date of Patent: Jun. 3, 1997

[54] ELECTRICAL CONNECTOR

[75] Inventors: Ittah Jean, Villeneuve la Garenne; Plessis Olivier, Voisin le Bretonneux, both of France

[73] Assignee: Connecteurs Cinch, Montigny le Bretonneux, France

[21] Appl. No.: 576,018

[22] Filed: Dec. 21, 1995

[30] Foreign Application Priority Data

Jan. 17, 1995 [FR] France ..... 95 00455

[51] Int. Cl.[6] ..... H01R 13/436

[52] U.S. Cl. ..... 439/752

[58] Field of Search ..... 439/752, 595

[56] References Cited

U.S. PATENT DOCUMENTS

| | | | |
|---|---|---|---|
| 5,017,163 | 5/1991 | Ohsumi | 439/752 |
| 5,100,346 | 3/1992 | McCardell | 439/752 |
| 5,356,317 | 10/1994 | Shinji | 439/752 |
| 5,516,308 | 5/1996 | Yamanashi | 439/752 |

FOREIGN PATENT DOCUMENTS

| | | |
|---|---|---|
| 417655 | 3/1991 | European Pat. Off. . |
| 3705739 | 8/1987 | Germany . |
| 4325371 | 3/1994 | Germany . |
| 2186748 | 8/1987 | United Kingdom . |

*Primary Examiner*—Gary F. Paumen

*Attorney, Agent, or Firm*—Greenblum & Bernstein P.L.C.

[57] ABSTRACT

An electrical connector comprises a body, a series of passages adapted to receive an electrical contact member and a locking key having two branches that are inserted into conduits in the body and bars that engage in slots in the body to lock the electrical contact members, cooperating with shoulders on the latter. The bars have a profile with a rib guided in a groove in the casing.

6 Claims, 7 Drawing Sheets

ELECTRICAL CONNECTOR

BACKGROUND OF THE INVENTION

1. Field of the Invention

The invention concerns an electrical connector.

The invention relates to a connector comprising an insulative material body having rows of passages into each of which is inserted a male or female electrical contact member crimped at one end to an electrical conductor.

2. Description of the Prior Art

The prior art (see patent GB-A-2 186 748 and patent DE-A-43 25 371) includes connectors of this kind that include a locking key formed by a U-shaped member with a series of bars upstanding from the center section in corresponding relationship to the rows of passages, the insulative material body including slots perpendicular to the passages into which the bars are inserted so that they bear against a shoulder on the electrical contact members to oppose accidental withdrawal of the latter.

These connectors have various drawbacks. If they are required to include different electrical contact members, i.e. to provide electrical connections with different current ratings, complex casing members and equally complex keys are required, which increases the cost of such connectors.

Further, the complexity of the shapes makes it difficult to manufacture very small connectors.

A first aim of the invention is to remedy this drawback.

SUMMARY OF THE INVENTION

The electrical connector of the invention comprises an insulative material body having a series of passages disposed in parallel rows and each adapted to receive a male or female electrical contact member crimped to one end of a conductor and having a shoulder partway along its length, the body including slots in the walls separating the rows of passages and conduits near two opposite walls, a key for locking the contact members being provided in the form of a U-shaped member with two branches adapted to be inserted into the conduits and a center section with upstanding therefrom a series of parallel bars adapted to be inserted into the slots and to cooperate with the shoulders of the electrical contact members to lock them in the passages, the slots are perpendicular to the axes of the passages and extend from one of the conduits adapted to receive one branch of the key to the other conduit adapted to receive the other branch, so as to form two lips in each wall separating the rows of passages, the bars having a profile featuring at least one rib facing towards one lip, the latter including a corresponding groove and edges projecting into the passages of two adjoining rows.

This connector has a simple structure, all the bars being identical; the passages can be adapted to receive electrical contact members having different dimensions but all having the same thinner part at the same height to fit in the gaps between the bars.

In accordance with one particular structural feature, the ribs are on the side facing towards the shoulders of the electrical contact members, the edges projecting into the passages of two adjoining rows being provided on either side of the ribs.

In very small connectors the link between the lip and the bar confers high mechanical strength which opposes flexing of the bar even if a high traction force is applied to pull out an electrical contact member.

As the bars are reinforced in this way, the key can be fitted only if all the electrical contact members are correctly in place.

As the passages are disposed in rows and the key is fitted parallel to the rows, the travel of said key on insertion is long, providing perfect verification of fitting of the electrical contact members.

It is often found at the time of fitting the connectors that the key has been misinserted. A second aim of the invention is to remedy this drawback. To this end each branch has on its outside face a lug sliding in a slot in the corresponding wall of the body.

The keys therefore remain attached to the connector bodies and this also facilitates mounting of the electrical contact members in the latter.

In accordance with one particular structural feature, the branches have a boss on each edge near their free end and detents are formed near the ends of the conduits, with which the bosses cooperate, the detents near one end corresponding to a ready position of the key and the detents near the other end corresponding to a locked position of the key.

To increase the elasticity of the branches in line with the bosses, each branch has an elongate opening at this point.

The connector of the invention is adapted to be inserted into a skirt of a complementary member and the body includes a housing in which the center section of the key engages in the locked position.

Accordingly the key is perfectly retained and cannot become unlocked when the body is accommodated in the skirt and, moreover, said key opposes assembly of the body and the complementary member if the key is not in the locked position, which it can only occupy if all of the electrical contact members are correctly in place in the passages.

One particular embodiment of the invention will now be described in more detail, by way of example only and with reference to the appended drawings.

DETAILED DESCRIPTION OF THE PREFERRED EMBODIMENT

Figure 1:
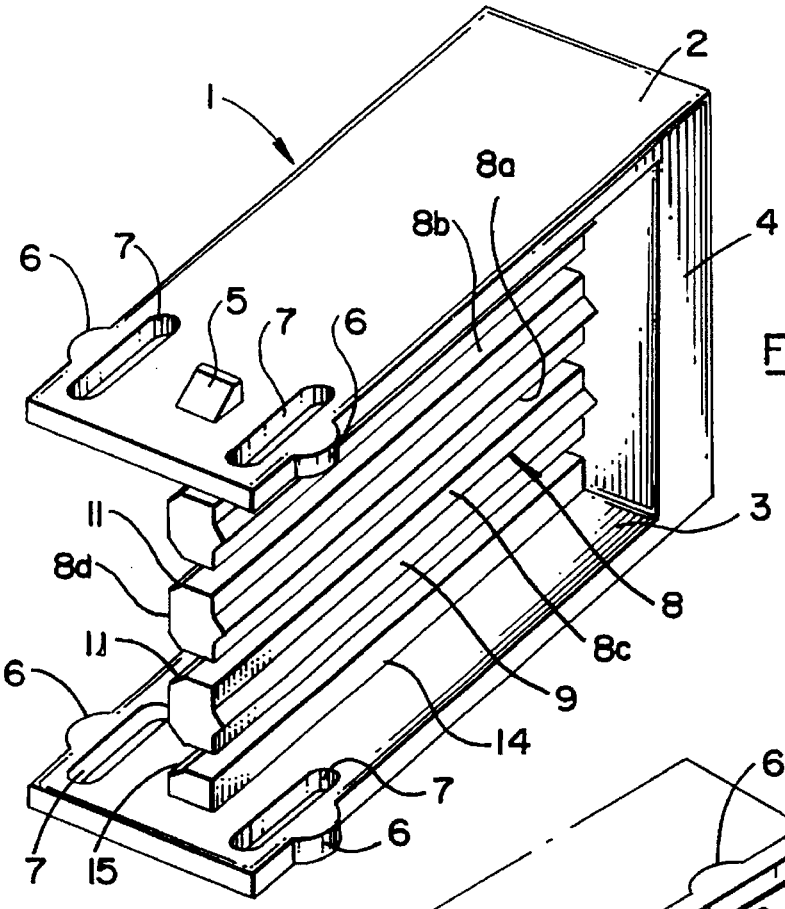
FIGS. 1 and 2 are perspective views of a locking key for an electrical connector in accordance with the invention.
Figure 2:
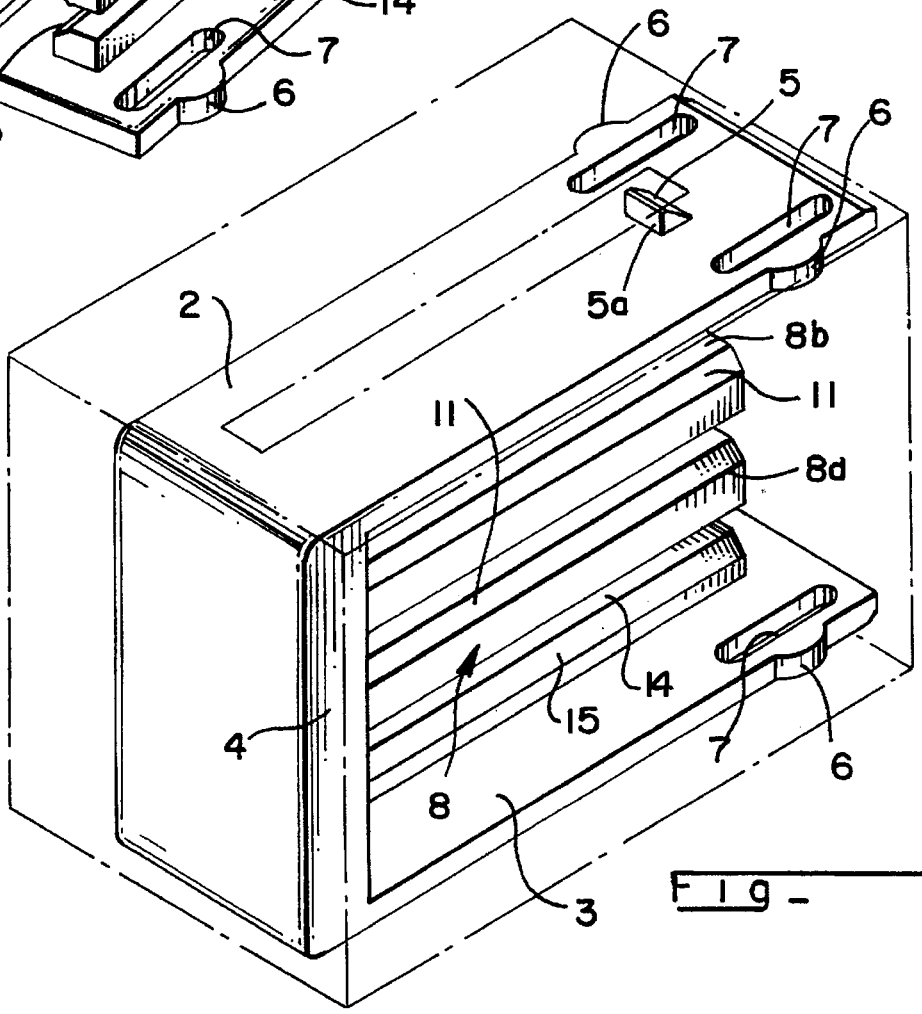

FIGS. 1 and 2 are perspective views of a key 1 adapted to be used in conjunction with a casing 20 of a connector.

The key is a U-shaped member with two branches 2 and 3 and a center section 4.

Each branch 2 and 3 has a retaining lug 5 on its outside face near its free end. This lug has a step 5*a* on the side facing away from said free end.

Each branch 2 and 3 has a boss 6 along each longitudinal edge near the free end and, in line with each boss, an elongate opening 7 to allow each boss 6 to retract elastically.

A series of bars 8 extends away from the inside surface of the center section 4 and parallel to the branches 2 and 3, each bar having a rectangular section with two shorter sides 8*a* and 8*b* and two longer sides 8*c* and 8*d*, the longer side 8*c* having a longitudinal median rib 9. The corners of the shorter sides 8*a* and 8*b* adjoining the longer side 8*d* are bevelled to form bevels 11.

The inside face of the branch 2 carries a protuberance 14 parallel to and coplanar with the bars 8, one face of this protuberance 14 having a bevel 15 corresponding to the bevels 11.

The inside face of the branch 3 also has a protuberance 14 with a bevel 15.

The casing 20 of the connector is in the form of a substantially parallelepiped-shaped body with a series of passages 17 and 18 in it each adapted to receive an electrical connection member 21.

Figure 3:
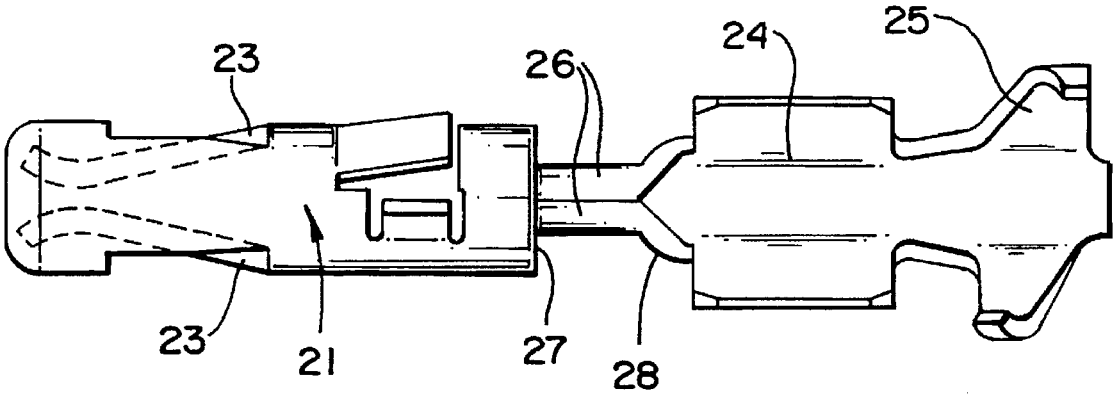
FIG. 3 is an elevation view of an electrical contact member adapted to be fitted into the electrical connector of the invention.
Figure 4:
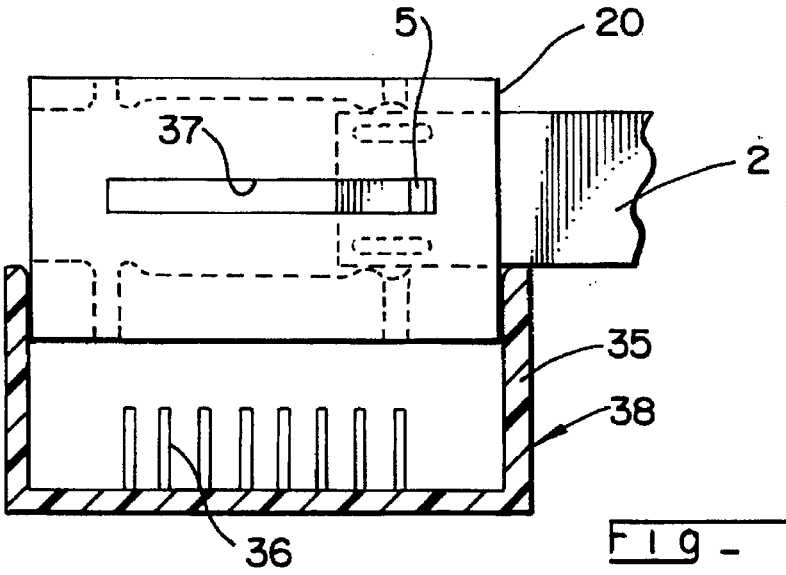
FIG. 4 is a diagrammatic elevation view of the electrical connector of the invention showing the key in the ready position.
Figure 6:
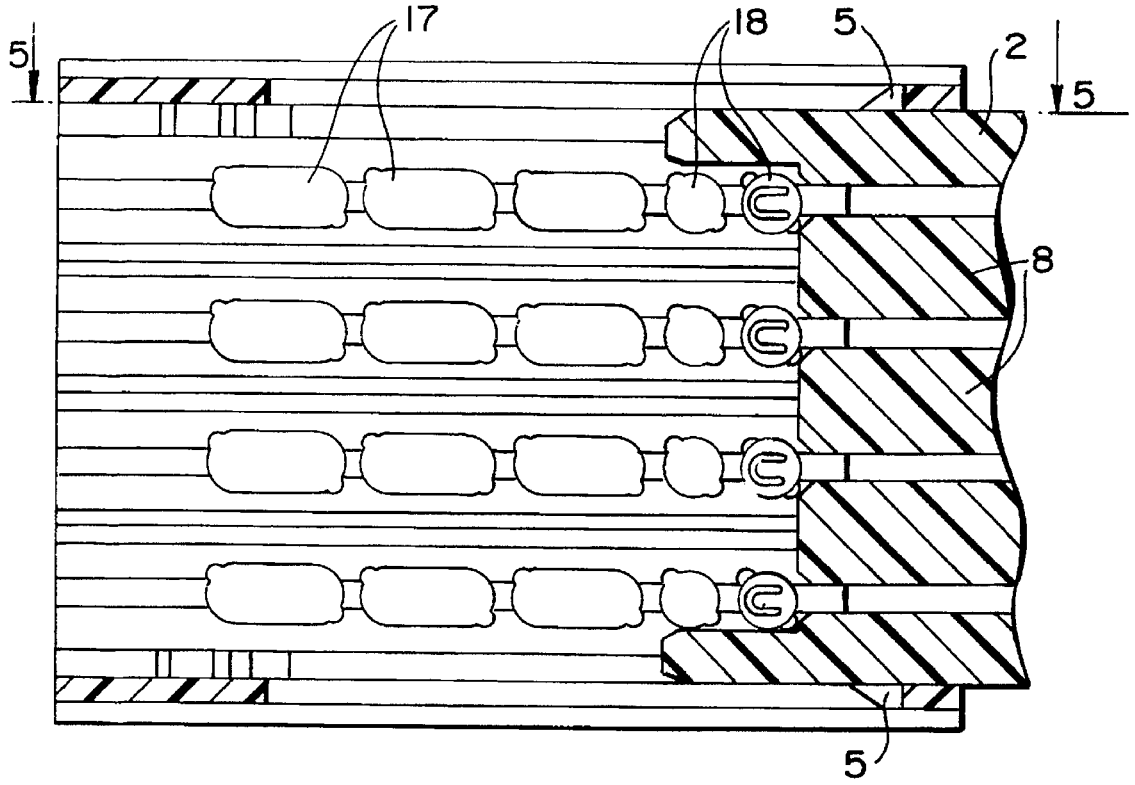
FIG. 6 is a view in section on the line 6—6 in FIG. 5.
Figure 5:
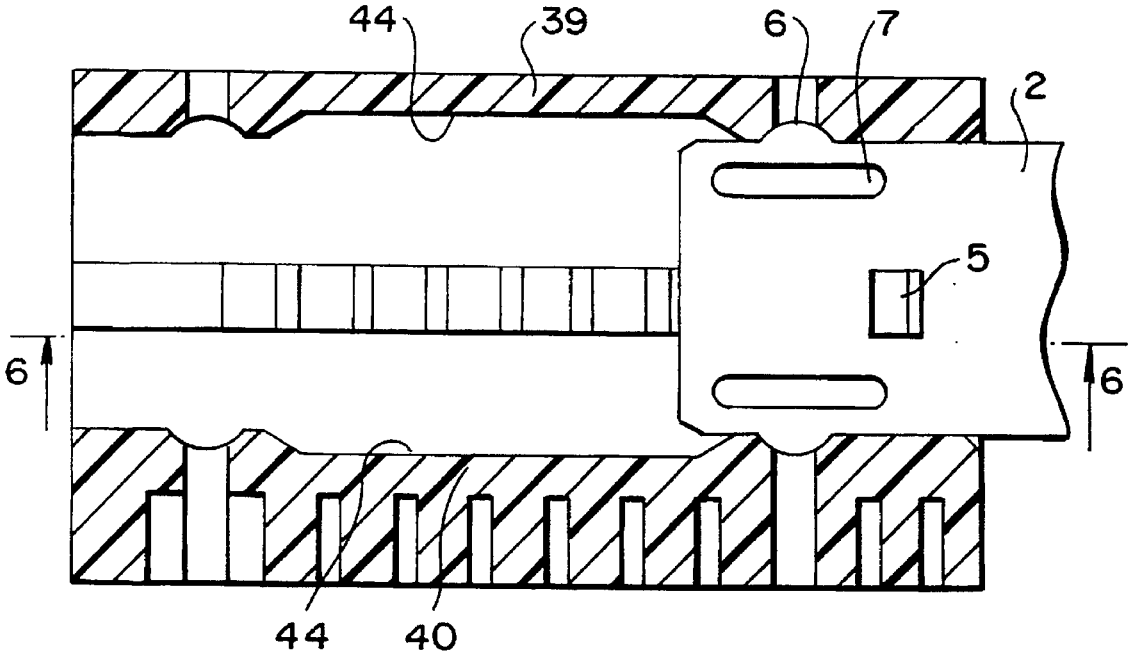
FIG. 5 is a view in section on the line 5—5 in FIG. 6.
Figure 10:
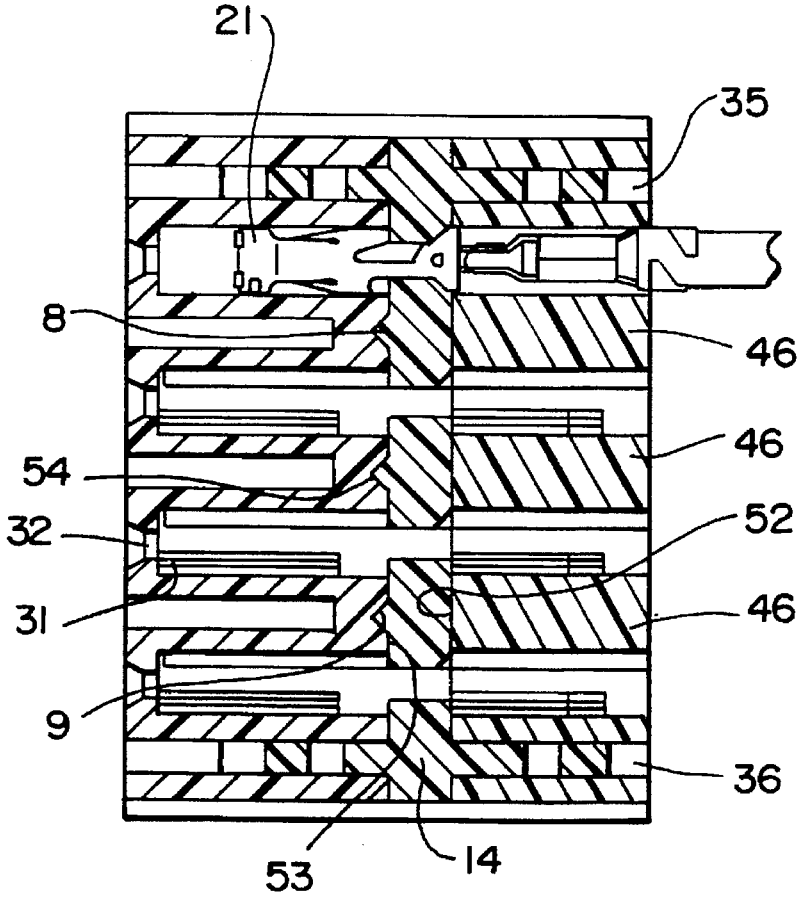
FIG. 10 is a view in section on the line 10—10 in FIG. 9.
Figure 7:
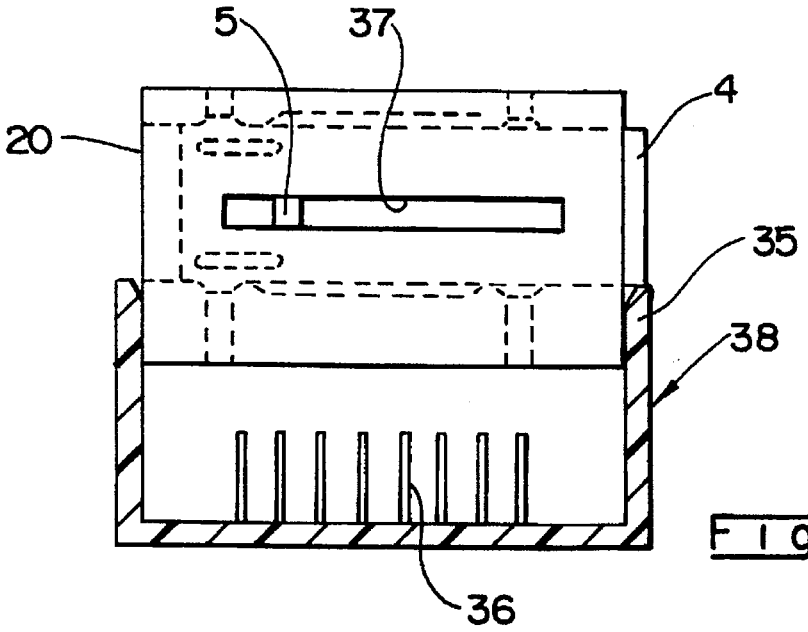
FIG. 7 is a diagrammatic elevation view of the electrical connector of the invention showing the key when it is not in the locked position.
Figure 9:
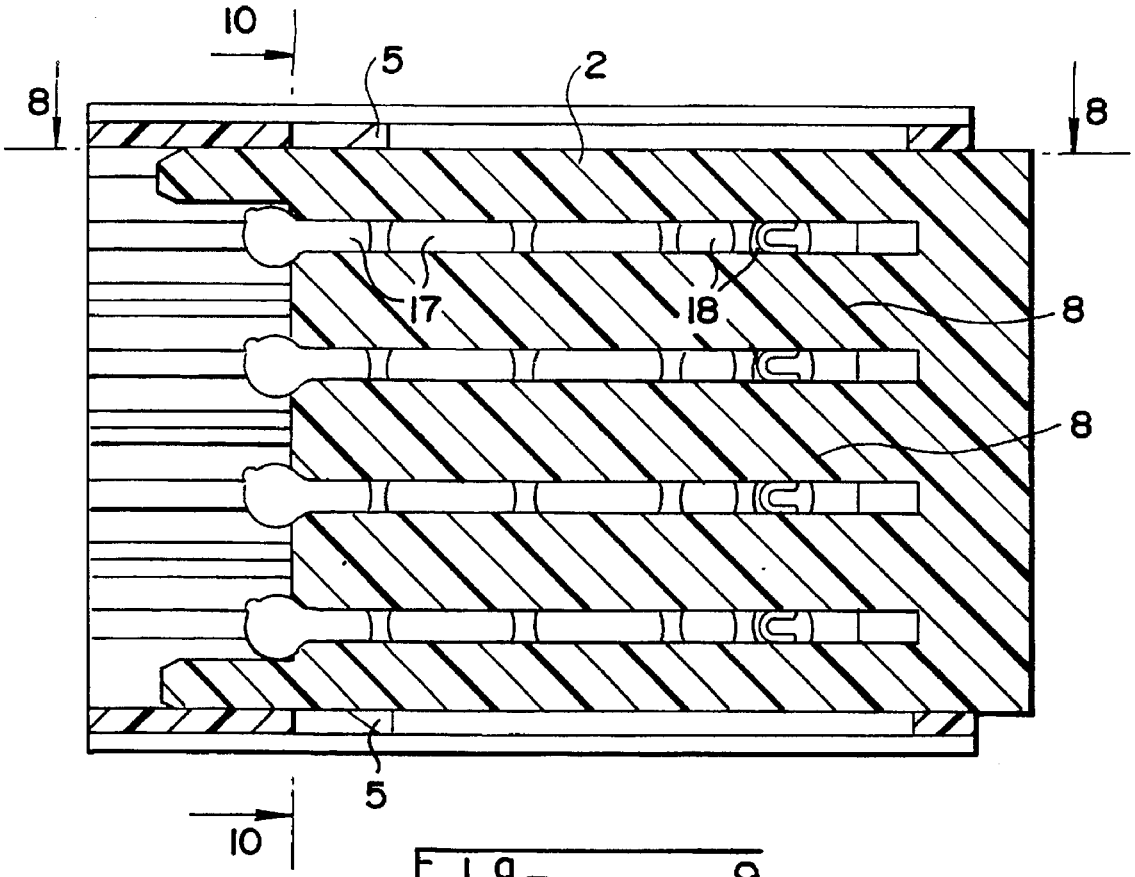
FIG. 9 is a view in section on the line 9—9 in FIG. 8.
Figure 8:
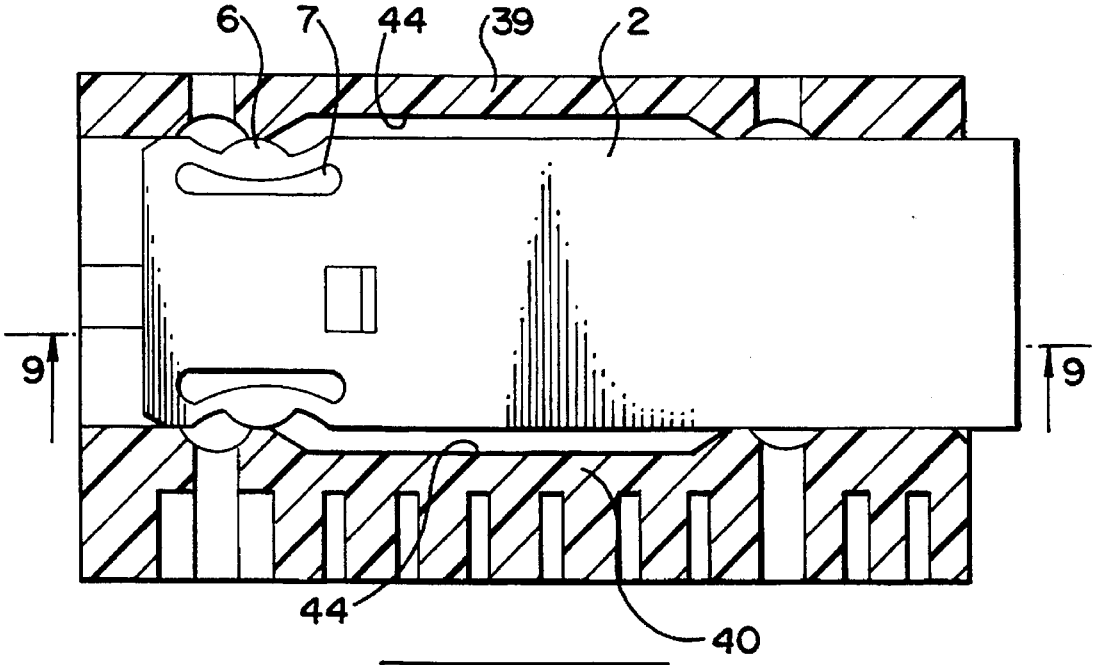
FIG. 8 is a view in section on the line 8—8 in FIG. 9.

FIG. 3 shows the member 21 to a larger scale. It has an elongate body made from a material that is a good conductor of electricity and has at one end an elastic clamp 23 adapted to grip a complementary male member and at the other end crimping lugs 24 and 25 for gripping an electrical connector. The body has a shoulder 27 joined to the part with the lugs 24 and 25 by a narrow part 26 ending in a slightly flared portion 28.

The member 21 can be various sizes depending on the electrical current to flow through it but the narrow part 26 is always the same, as is the distance between the shoulder 27 and the free end, regardless of the size of the member.

The passages 17 receive members 21 larger than those inserted into the passages 18.

Each passage 17 and 18 has at one end an opening 30 into which a member 21 is inserted and at the other end a shoulder 31 for retaining said member 21 with its slot 32.

The casing 20 is adapted to be inserted into a skirt 35 of a female member 38, upstanding from the back of which are male members 36 adapted to pass through the slots 32 and to be inserted into the elastic clamps 23.

The casing 20 includes conduits 35 and 36 respectively adapted to receive the branches 2 and 3, each conduit having a slot 37 in which the corresponding lug 5 can slide. Thus the key can slide freely in the conduits in the casing but cannot separate from the latter.

On two opposite walls 39 and 40 of each conduit 35 and 36 are first detents 41 for locking the key in a prelocked position and second detents 42 corresponding to a locked position of the key. The bosses 6 can engage with the detents 41 or 42 subject to slight elastic deformation facilitated by the slot 7.

The bosses 6 are inserted in grooves 43 and 44 in the walls 39 and 40, respectively, between the detents 41 and 42.

The passages 17 and 18 are arranged in series aligned in parallel, each series being separated from the adjacent series by a wall 46 and the face 8c of the bars 8 on the same side as the shoulders 31 projecting across two adjacent rows of passages 17, 18.

Slots 48 with lips 52 and 53 are formed in the walls 46, parallel to the conduits 35 and 36. Slots 50 are formed in the walls adjacent the passages 35 and 36, parallel to the conduits 35 and 36. The slots 48 extend from the conduit 35 to the conduit 36.

A lip 53 of the slots 48 includes a groove 54 to guide the rib 9.

The protuberances 14 are inserted in the sloes 50.

The casing 20 has a housing 55 at one end into which the end of the key 1 including the center section 4 is inserted so that said key does not project beyond the surface of said casing when it is in the locked position.

Figure 14:
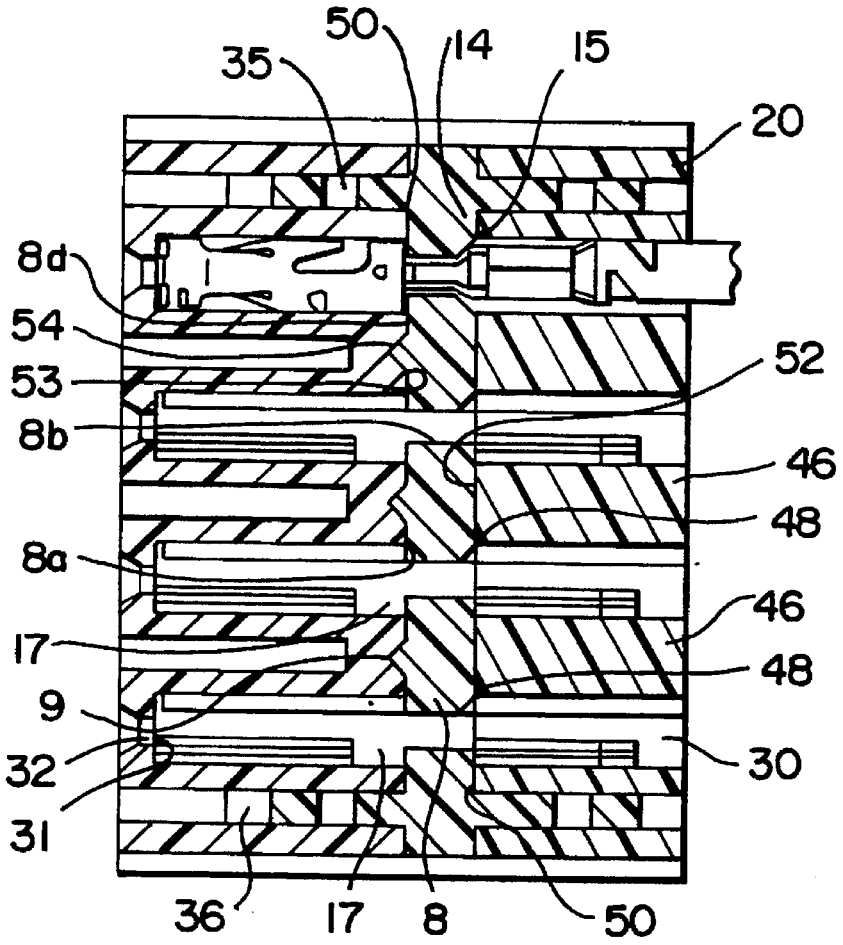
FIG. 14 is a view in section on the line 14—14 in FIG. 13.
Figure 11:
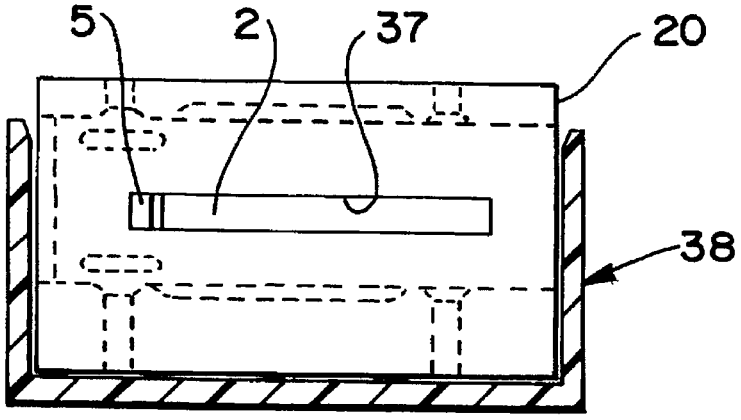
FIG. 11 is a part-sectional elevation view of the assembled connector.
Figure 13:
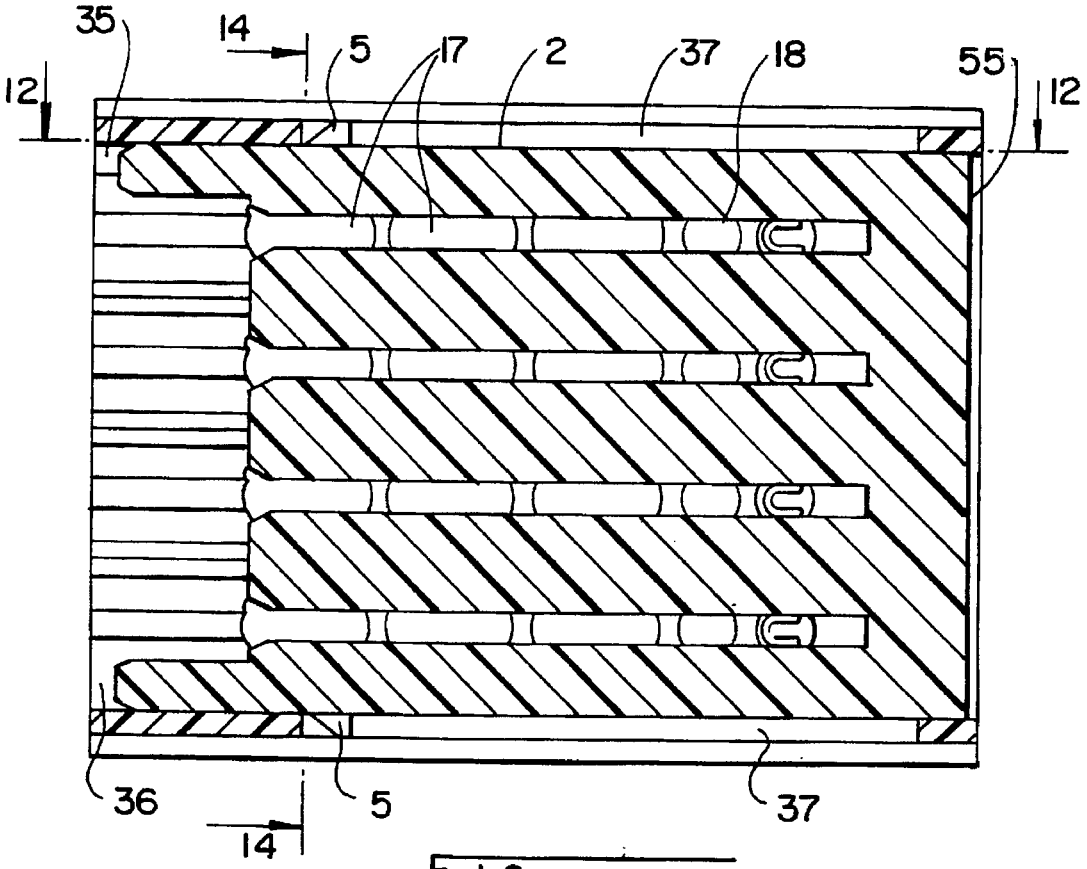
FIG. 13 is a view in section on the line 13—13 in FIG. 12.
Figure 12:
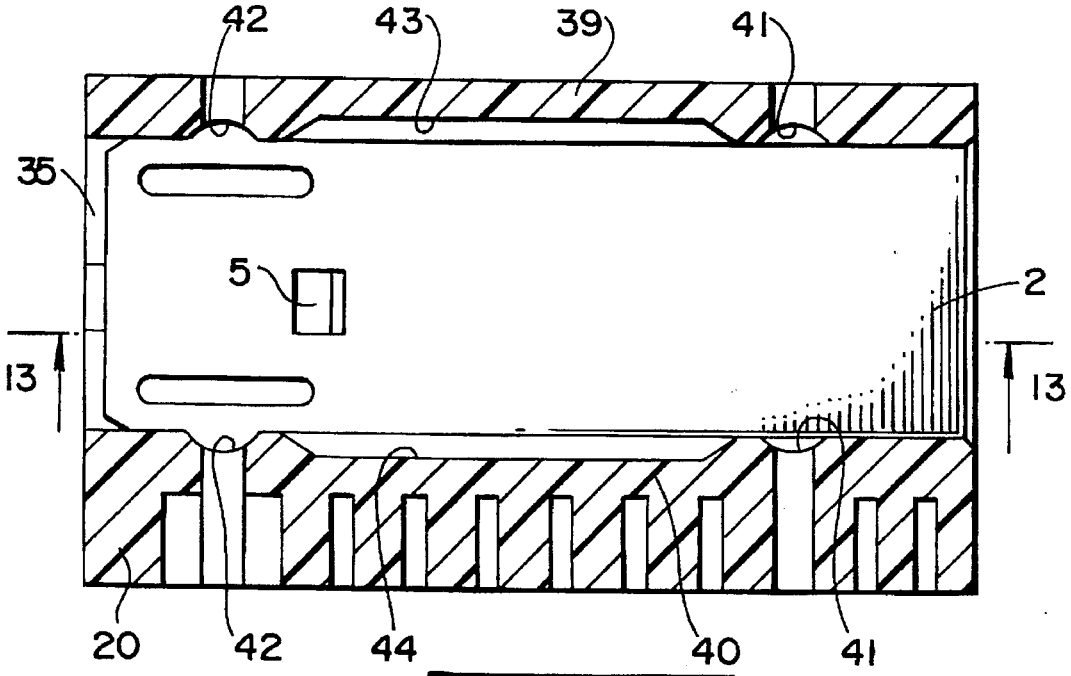
FIG. 12 is a view in section on the line 12—12 in FIG. 13.

FIG. 14 shows that the shorter sides 8*b* of the bars 8 project into the passages 17 of a first row and their shorter sides 8*a* project into the passages of a row adjacent said first row. Accordingly, the longer sides 8*c* operate with the shoulders 27 to oppose withdrawal of the members 21 when they are housed in the passages 17, the bevels 11 accommodating the slightly flared portions 28.

If a member 21 is not correctly in place, the bar 8 abuts against it and the key 1 cannot be pushed in as far as its locked position (see FIGS. 7, 8, 9 and 10).

As the rib 9 on the bars 8 cooperates with the slot 54, said bars in practise form an integral part of the connector and oppose accidental pulling out of the members 21.

In the embodiment shown the electrical contact members 21 are female, but they could be male instead, of course.

Of course, the invention is not limited to the embodiment just described and shown. Many modifications of detail can be made thereto without departing from the scope of the invention.

There is claimed:

1. Electrical connector comprising an insulative material body having a series of passages disposed in parallel rows and each adapted to receive a male or female electrical contact member crimped to one end of a conductor and having a shoulder partway along its length, said body including slots in walls separating said rows of passages and conduits near two opposite walls, a key for locking said contact members being provided in the form of a U-shaped member with two branches adapted to be inserted into said conduits and a center section with upstanding therefrom a series of parallel bars adapted to be inserted into said slots and to cooperate with said shoulders of said electrical contact members to lock them in said passages, wherein said slots are perpendicular to the axes of said passages and extend from one of said conduits adapted to receive one branch of said key to the other conduit adapted to receive the other branch, so as to form two lips in each wall separating said rows of passages, said bars each having a profile featuring at least one rib facing towards one lip, the lip including a corresponding groove to receive the rib and edges projecting into the passages of two adjoining rows.

2. Electrical connector according to claim 1 wherein said ribs are on the side facing towards said shoulders of said electrical contact members, said edges projecting into said passages of two adjoining rows being provided on either side of said ribs.

3. Electrical connector according to claim 1 wherein each branch includes on its outside face a lug sliding in a slot in a corresponding wall of said body.

4. Electrical connector according to claim 1 wherein said branches have a boss on each edge near their free end and detents are formed near the ends of said conduits, with which said bosses cooperate, said detents near one end corresponding to a ready position of said key and said detents near the other end corresponding to a locked position of said key.

5. Electrical connector according to claim 4 wherein each branch includes an elongate opening in line with said bosses.

6. Electrical connector according to claim 1 wherein said branches have a boss on each edge near their free end and detents are formed near the ends of said conduits, with which said bosses cooperate, said detents near one end corresponding to a ready position of said key and said detents near the other end corresponding to a locked position of said key, and wherein said body is adapted to be inserted into a skirt of a complementary member and includes a housing in which said center section of said key engages in said locked position.

* * * * *